United States Patent [19]

Shiba et al.

[11] 3,970,461

[45] July 20, 1976

[54] FOGGED, DIRECT-POSITIVE SILVER HALIDE EMULSION CONTAINING CARBOCYANINE DYE HAVING INDOLENINE NUCLEUS

[75] Inventors: Keisuke Shiba; Masanao Hinata; Akira Sato; Akira Ogawa; Hirotetu Kato, Minami-ashigara, Japan

[73] Assignee: Fuji Photo Film Co., Ltd., Minami-ashigara, Japan

[22] Filed: July 6, 1973

[21] Appl. No.: 376,997

Related U.S. Application Data

[63] Continuation-in-part of Ser. No. 185,819, Oct. 1, 1971, abandoned.

[30] Foreign Application Priority Data

Oct. 1, 1970 Japan ..... 45-86241

[52] U.S. Cl. ..... 96/101; 96/107; 96/135; 96/137; 96/138

[51] Int. Cl.[2] ..... G03C 1/28; G03C 1/36; G03C 1/08

[58] Field of Search ..... 96/107, 108, 101, 137, 96/138, 135

[56] References Cited

UNITED STATES PATENTS

| | | | |
|---|---|---|---|
| 3,367,778 | 3/1970 | Berriman | 96/137 |
| 3,501,311 | 3/1970 | Lincoln et al. | 96/137 |
| 3,615,643 | 10/1971 | Shiba et al. | 96/137 |
| 3,660,102 | 5/1972 | Riester | 96/137 |
| 3,660,103 | 5/1970 | Kampfer et al. | 96/137 |
| 3,782,957 | 1/1974 | Ohkubo et al. | 96/101 |

*Primary Examiner*—Won H. Louie, Jr.
*Attorney, Agent, or Firm*—Sughrue, Rothwell, Mion, Zinn, & Macpeak

[57] ABSTRACT

A direct positive silver halide photographic emulsion containing a dye represented by the following general formula:

$(X^-)^{m-1}$ wherein R and $R_1$ are selected from the first group consisting of alkyl, allyl, substituted alkyl, aryl, and substituted aryl groups, at least one of the R and $R_1$ being an alkyl group substituted with a carboxyl or sulfo radical; $R_2$ and $R_3$ are selected from the second group consisting of alkyl, aralkyl and allyl groups; $L_1$ is selected from the third group consisting of methine and an atomic group capable of combining with $R_1$, $R_2$ or $R_3$ to form a ring; $L_2$ is methine; $L_3$ is selected from the fourth group consisting of methine and an atomic group capable of forming a ring with $R_1$ or a 3,3-substituent of an indolenine ring at the site near to $L_3$, $L_3$, such that a ring may be formed by $L_1$ and $L_3$; x is an anion; *n* and *m* are the integers 1 and 2, respectively, such that when said dye forms in intramolecular salt, *m* is 1; Z is an atomic group capable of completing a benzene ring or a naphthalene ring; and $Z_1$, is a non-metallic atomic group capable of completing a 5- or 6- member heterocyclic ring.

14 Claims, No Drawings

FOGGED, DIRECT-POSITIVE SILVER HALIDE EMULSION CONTAINING CARBOCYANINE DYE HAVING INDOLENINE NUCLEUS

CROSS-REFERENCES TO RELATED APPLICATIONS

This application is a continuation in part of U.S. Application Ser. No. 185,819 filed Oct. 1, 1971 by Shiba et al and entitle "Direct Positive Silver Halide Photographic Emulsion", now abandoned and claiming the priority of Japanese Application 86241/70 filed Oct. 1, 1970, a certified copy thereof having been lodged therein.

BACKGROUND OF THE INVENTION

1. Field of the Invention

This invention relates to a silver halide photographic emulsion and particularly to a direct positive silver halide photographic emulsion to which fog was previously applied.

2. Description of the Prior Art

When a silver halide light-sensitive element is exposed to light including that within the region of the light-sensitive wavelength of the light-sensitive element and developed, the photographic density thereof increases in accordance with the increase of the exposure quantity, and finally reaches its maximum value. In this case, however, when the exposure quantity further increases, the photographic density decreases again and finally a positive image is formed. Such a phenomenon is generally called "solarization". Furthermore, a similar reversal phenomenon as results from the exposure to light is observed in a silver halide emulsion optically or chemically fogged during the production process.

It is well-known that when a sensitizing dye having a sensitizing function with respect to an ordinary negative-positive type emulsion, such as a carbocyanine dye, is added to a previously fogged photographic emulsion an increase of reversal sensitivity and magnification of the region of reversal light-sensitive wavelengths are observed.

According to U.S. Pat. No. 2,323,187 a carbocyanine dye is advantageous for reversal sensitization in a larger quantity range than in an ordinary negative-positive type emulsion. In general, a sensitizing dye, particularly in the case where the quantity added is large, leaves residual coloring in a colloidal image supporting layer and/or auxiliary layer. Such a residual color effect is unfavorable in, for example, photographic papers. That is, a bright white color cannot be obtained in monochromatic photographs and, on the other hand, the reproduction of true color is impossible in color photographs.

When pink or yellow color remains in a photographic paper, another disadvantage is observed, that is, in the case a part of a completed photograph is irradiated with sunlight or the like, the dye of the corresponding part is bleached by the light, and, as a result, an image, one part of which is white and the other part of which is colored, is obtained. Accordingly, in the case when a photographic emulsion which was previously fogged with a sensitizing dye is sensitized, it is important that the occurrence of coloring in the finished photograph be avoided.

Furthermore, as shown in Japanese Pat. No. 4125/1968, a reversal sensitization is attained more advantageously in the case when an emulsion containing a rhodium compound is sensitized with a cyanine dye than in the case where a desensitizing organic compound having a desensitizing function when added to an ordinary negative-positive type emulsion, for example, pinakryptol yellow, and a cyanine dye are jointly employed.

In the case when the emulsion containing a rhodium compound is sensitized with a cyanine dye, it is important, from a technical viewpoint, that a desensitizing organic compound such as pinakryptol yellow be further added to the emulsion in order to lower the minimum concentration of its reversal curve, to thereby obtain a clearer image. In this case, there is a tendency for the desensitizing organic compound to deteriorate the reversal sensitivity caused by the cyanine dye. Therefore, in the above-mentioned case, a sensitizing dye, the deterioration of the reversal sensitivity of which is small, even when a desensitizing organic compound is also present, is required.

OBJECTS OF THE INVENTION

It is an object of the present invention to provide a direct positive silver halide photographic emulsion containing a sensitizing dye having high reversal sensitivity even in the presence of a desensitizing organic compound the emulsion having no substantial residual coloring after treatment with the sensitizing coloring dye.

Other objects will be apparent to those skilled in the art as the description of this invention proceeds.

DESCRIPTION OF THE INVENTION

Objects of the present invention are attained by including a carbocyanine dye having an indolenine nucleus and represented by the following general formula (I) into a direct positive emulsion.

General Formula (I)

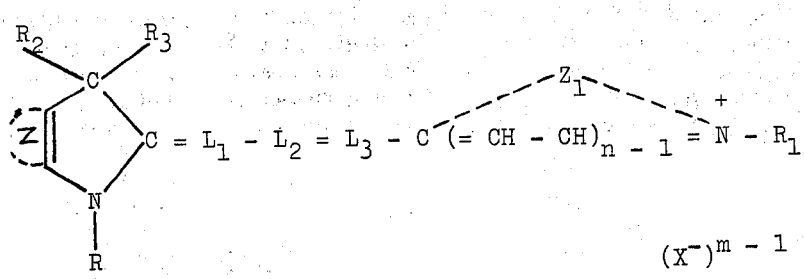

in which $L_1$ is methine or an atomic group required for forming a ring combined with R, $R_2$, or $R_3$, $L_2$ is methine, $L_3$ is methine or an atomic group required for forming a ring combined with $R_1$ or a 3,3-substituent of the indolenine ring at the site near to $L_3$ and further, a ring may be formed by combining $L_1$ with $L_3$, R and $R_1$ each represents an alkyl group or an aryl group, at least one of R and $R_1$ being an alkyl group containing a carboxyl or sulfo radical, $R_2$ and $R_3$ each represents an alkyl group, X is anion,

*n* and *m* are each integers 1 or 2, and in the case when the above described dye forms an intramolecular salt, *m* is 1, Z is an atomic group required for completing a benzene ring or naphthalene ring which may be substituted and $Z_1$ is a non-metallic atomic group required for completing a five- or six- membered heterocyclic ring.

As examples of alkyl groups represented by R and $R_1$, there are methyl, ethyl, propyl, isopropyl, butyl, hexyl, cyclohexyl, decyl, dodecyl, 2-hydroxyethyl, 3-hydroxypropyl, 2-methoxyethyl, beta-acetoxyethyl, gamma-acetoxypropyl, alkyl groups having a carboxyl radical (e.g., carboxymethyl, 2-carboxyethyl, 3-carboxypropyl, p-carboxybenzyl or 2-(2-carboxyethoxy)ethyl), alkyl groups having a sulfo radical, (e.g., 2-sulfoethyl, 3-sulfopropyl, 4-sulfobutyl, 2-hydroxy-1-sulfopropyl, 2-(3-sulfopropoxy)ethyl, 2-acetoxy-1-sulfopropyl, 3-methoxy-2-(3-sulfopropoxy)propyl, 2-[2-(3-sulfopropoxy) ethoxy]ethyl p-sulfobenzyl, p-sulfophenylethyl, or 2-hydroxy-3-(3′-sulfopropoxy)propyl)-benzyl, phenylethyl, and allyl.

As examples of aryl groups represented by R and $R_1$, there are phenyl, tolyl, naphthyl, methoxyphenyl, and chlorophenyl.

As examples of alkyl groups represented by $R_2$ and $R_3$ there are methyl, ethyl, propyl, isopropyl, butyl, hexyl, decyl, dodecyl, benzyl, phenylethyl and allyl.

As examples of anions represented by X, there are chloride, bromide, iodide, thiocyanate, sulfonate, perchlorate, p-toluenesulfonate, methylsulfonate, and ethylsulfate.

As examples of heterocyclic rings completed by $Z_1$, there are thiazole rings, e.g., thiazole, 4-methylthiazole, 4-phenylthiazole, 5-methylthiazole, 5-phenylthiazole, 4, 5-dimethylthiazole, 4, 5-diphenylthiazole, or 4-(2-thienyl)thiazole, benzothiazole rings, e.g., benzothiazole, 4-chlorobenzothiazole, 5-chlorobenzothiazole, 6-chlorobenzothiazole, 7-chlorobenzothiazole, 4-methylbenzothiazole, 5-methylbenzothiazole, 6-methylbenzothiazole, 5-bromobenzothiazole, 6-bromobenzothiazole, 5-phenylbenzothiazole, 6-phenylbenzothiazole, 4-methoxybenzothiazole, 5-methoxybenzothiazole, 6-methoxybenzothiazole, 5-iodobenzothiazole, 6-iodobenzothiazole, 4-ethoxybenzothiazole, 5-ethoxybenzothiazole, tetrahydrobenzothiazole, 5,6-dimethoxybenzothiazole, 5,6-dimethylbenzothiazole, 5-hydroxybenzothiazole, or 6-hydroxybenzothiazole, napthothiazole rings, e.g., alpha-naphthothiazole, beta-naphthoazole, beta, beta-naphthothiazole, 5-methoxy-beta, beta-naphthothiazole, 5-ethoxy-beta-naphthothiazole, 8-methoxy-alpha-naphthothiazole, 7-methoxy-alpha-naphthothiazole, or 4′-methoxythionaphthene-7′, 6′, 4, 5-thiazole, oxazole rings, e.g., 4-methyloxazole, 5-methyloxazole, 4-phenyloxazole, 4, 5-diphenyloxazole, 4, 5-dimethyloxazole, 4-ethyloxazole, or 5-phenyloxazole; benzoxazole rings, for example, benzoxazole, 5-chlorobenzoxazole, 5-methylbenzoxazole, 5-phenylbenzoxazole, 6-methylbenzoxazole, 4, 6-dimethylbenzoxazole, 5-methoxybenzoxazole, 5-ethoxybenzoxazole, 5-bromobenzoxazole, 5-iodobenzoxazole, 6-methoxybenzoxazole, 5-hydroxybenzoxazole, or 6-hydroxybenzoxazole; selenazole rings, e.g., 4-methylselenazole, or 4-phenylselenazole; benzoselenazole rings, for example, benzoselenazole, 5-chlorobenzoselenazole, 5-methoxybenzoselenazole, 5-hydroxybenzoselenazole, or tetrahydrobenzoselenazole; naphthoselenazole rings, for example, alpha-naphthoselenazole, or beta-naphthoselenazole, thiazoline rings, for example, thiazoline, or 4-methylthiazoline; oxazoline rings, e.g., for example, oxazoline; pyridine rings, e.g., 2-pyridine, 5-methyl-2-pyridine, 4-pyridine, or 3-methyl-4-pyridine, quinoline rings, e.g., 2-quinoline, 3-methyl-2-quinoline, 5-ethyl-2-quinoline, 6-chloro-2-quinoline, 8-chloro-2-quinoline, 6-methoxy-2-quinoline, 8-ethoxy-2-quinoline, 8-hydroxy-2 -quinoline, 8-methyl-2-quinoline, 4-quinoline, 6-methoxy-4-quinoline, 7-methyl-4-quinoline, 8-chloro-4-quinoline, 1-isoquinoline, 3, 4-dihydro-1-isoquinoline, or 3-isoquinoline, 3,3-substituted indolenine rings, e.g., 3,3-dimethyl-indolenine, 3,3, 5-trimethylindolenine, 3,3-dimethyl-5-methoxy-indolenine, 3,3-dimethyl-5-ethoxycarbonylindolenine, 3,3,5,6-tetra-methyl-indolenine, 3,3-diethylindolenine, 3,3-dimethyl-5-chloroindolenine, 3,3-dibenzylindolenine, 3,3-diallylindolenine, 3,3-dimethyl-5-cyanoindolenine, 3,3-dimethyl-6-cyanoindolenine, 3,3-dimethyl-6-cyanoindolenine, 3,3-dimethyl-5-chloroindolenine, 3,3-dimethylbenzo[4,5] indolenine, and 3,3-dimethyl-benzo[6,7]indolenine; imidazole rings, e.g., imidazole, 1-alkyl-imidazole, 1-alkyl-4-phenylimidazole, 1-alkyl-4,5-dimethylimidazole, benzimidazole, 1-alkylbenzimidazole, 1-aryl-5-, 6-dichlorobenzimidazole, 1-alkyl-alpha-naphthoimidazole, 1-aryl-beta-naphthoimidazole, or 1-alkyl-5-methoxy-alpha-naphthoimidazole, and the like.

The carboxyanine dyes having an indolenine nucleus employed for the present invention are well known and they can be easily synthesized by those skilled in the art by referring to pages 162 – 199 of "The Cyanine Dyes and Related Compounds" authored by F. M. Hamer and published by Interscience Publishers in 1964.

The examples of the dyes employed for the present invention will be specifically illustrated hereinbelow. It is, however, to be noted that dyes useful in the present invention are not limited to those illustrated below:

Dye 1

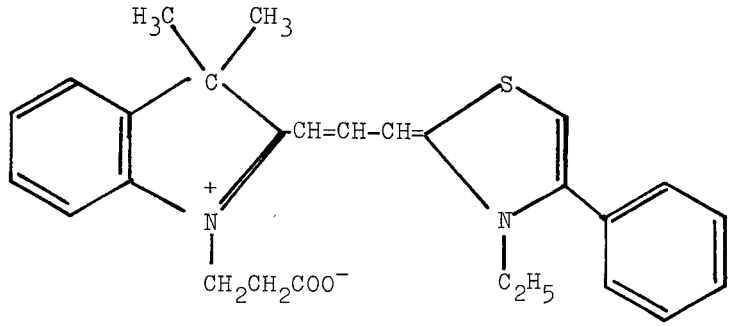

Dye 2
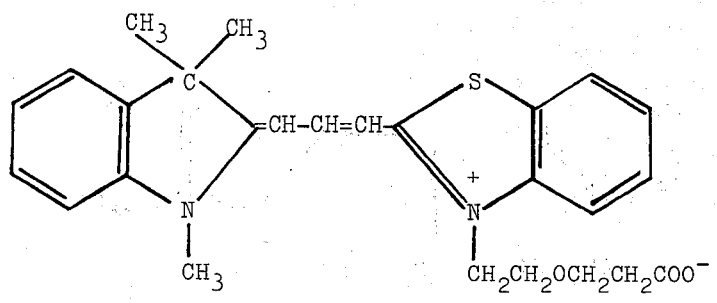
Dye 3
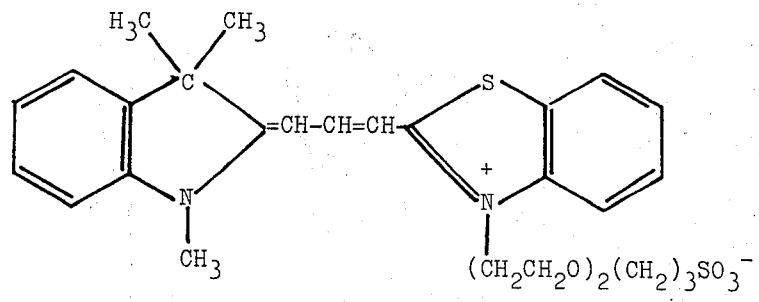
Dye 4
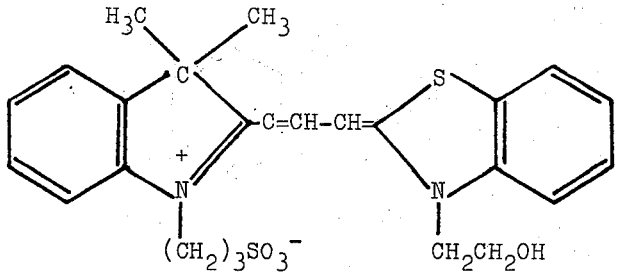
Dye 5
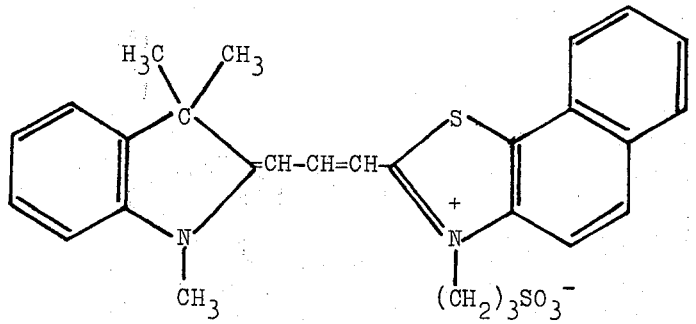
Dye 6
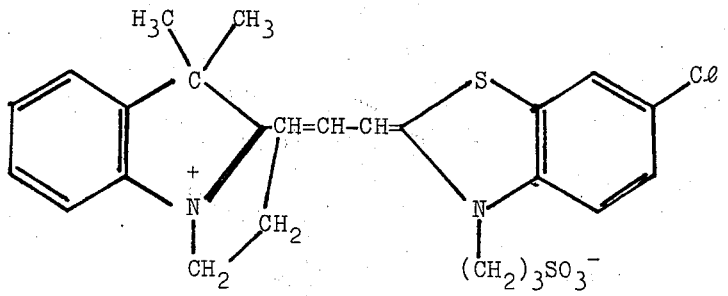

Dye 7
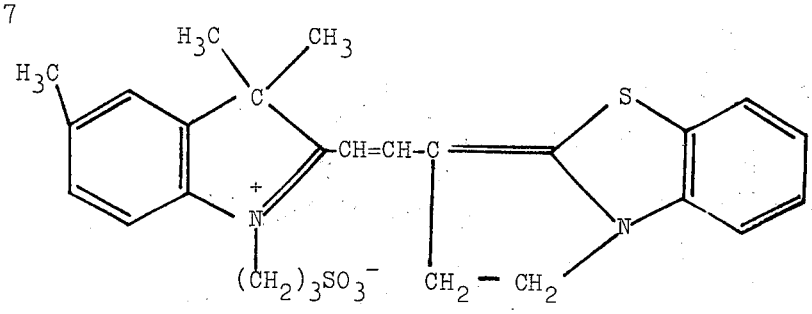
Dye 8
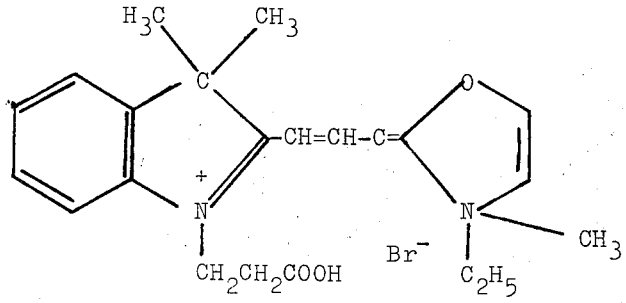
Dye 9
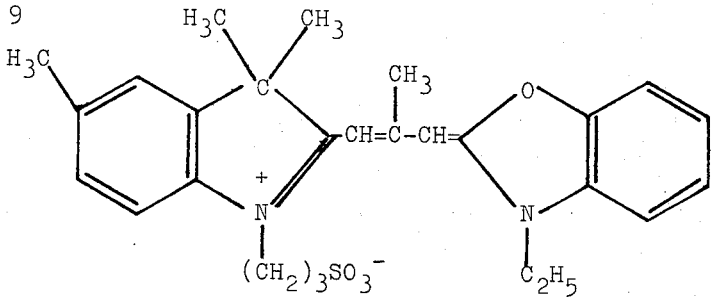
Dye 10
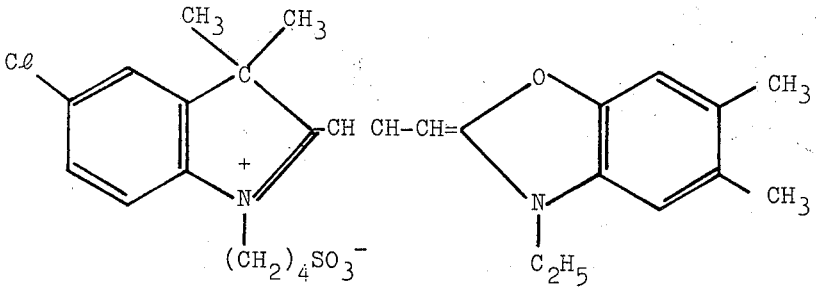
Dye 11
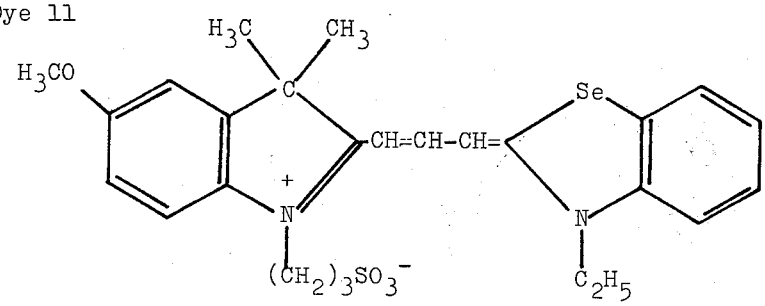

Dye 12
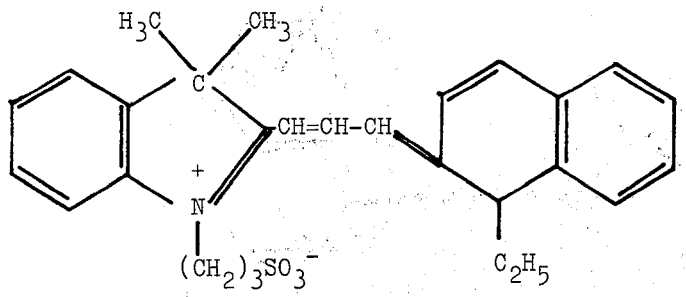
Dye 13
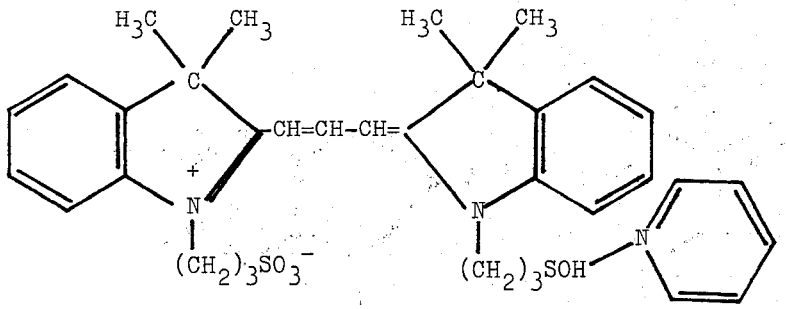
Dye 14
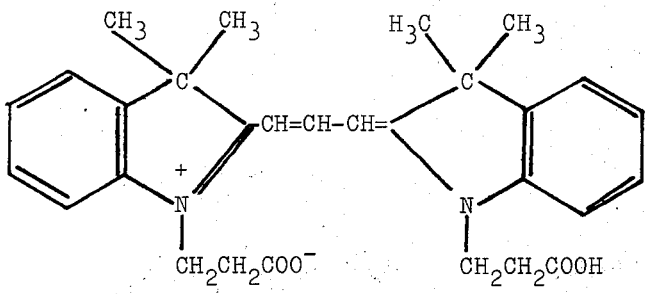
Dye 15
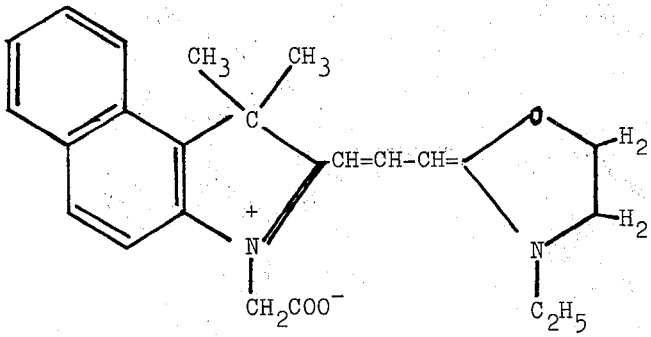
Dye 16
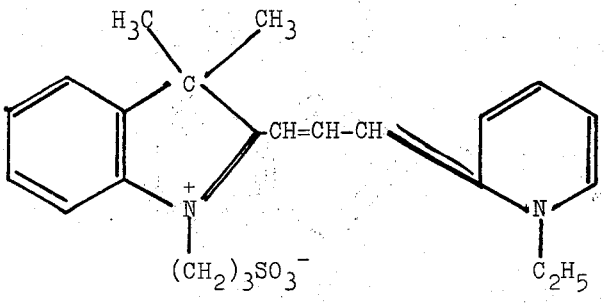

Dye 17
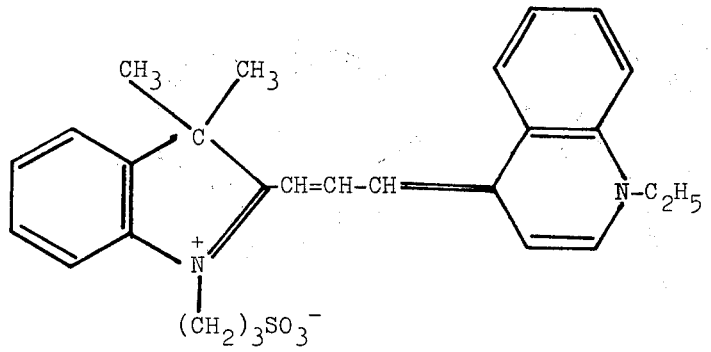
Dye 18
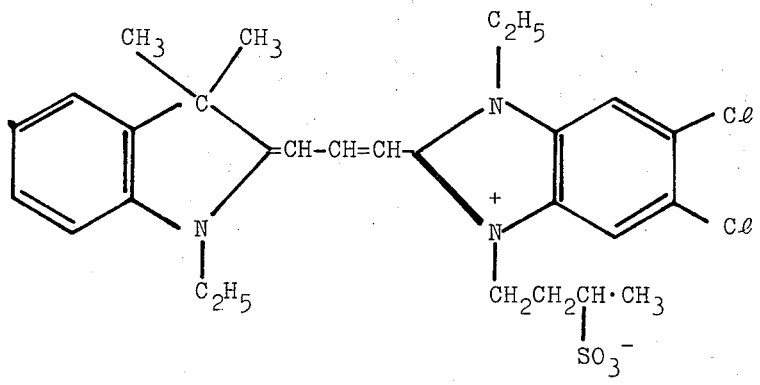
Dye 19
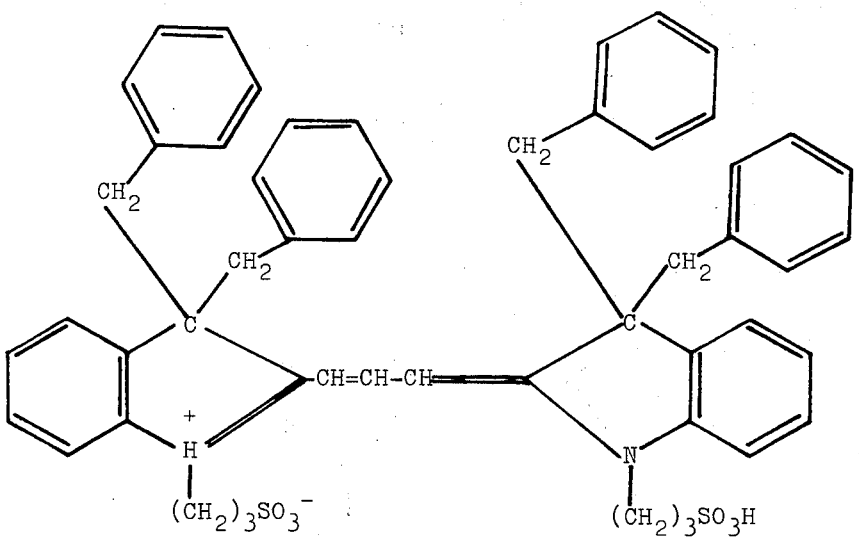
Dye 20
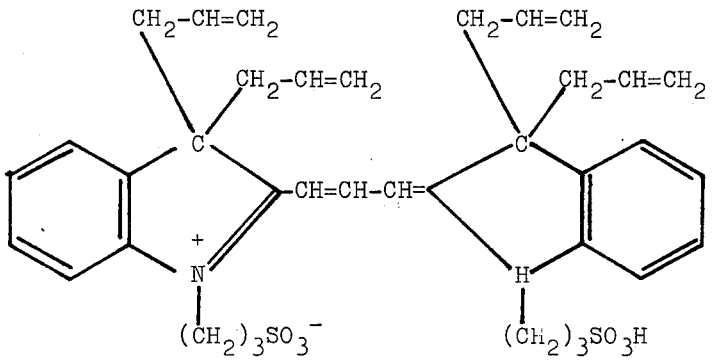

Dye 21
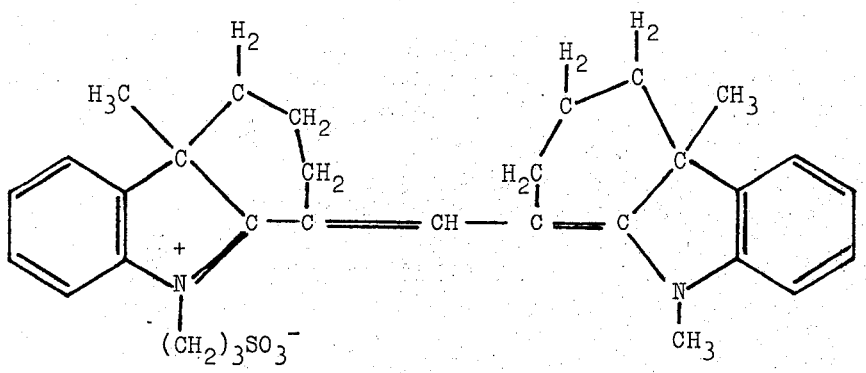
Dye 22
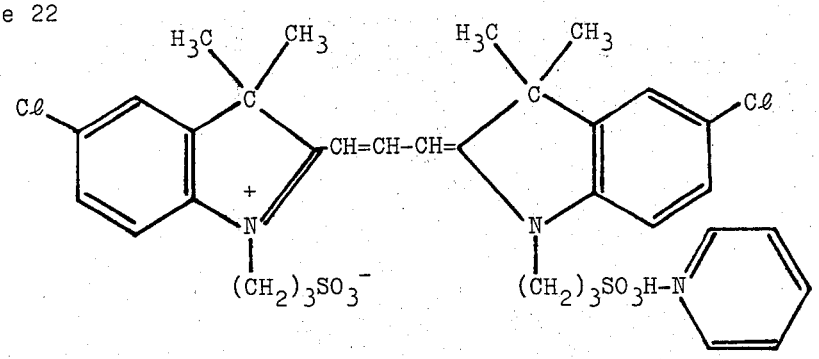
Dye 23
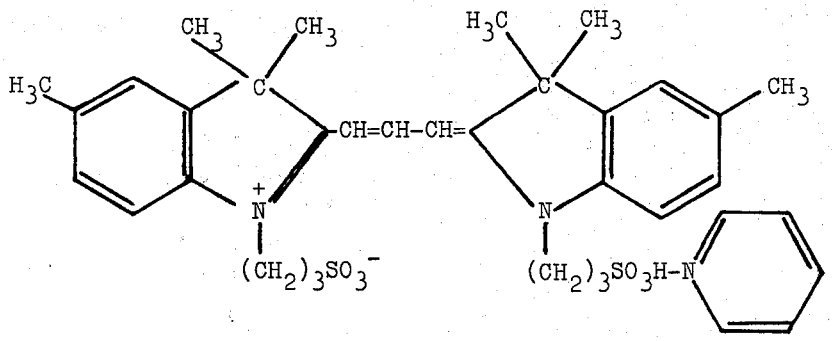
Dye 24
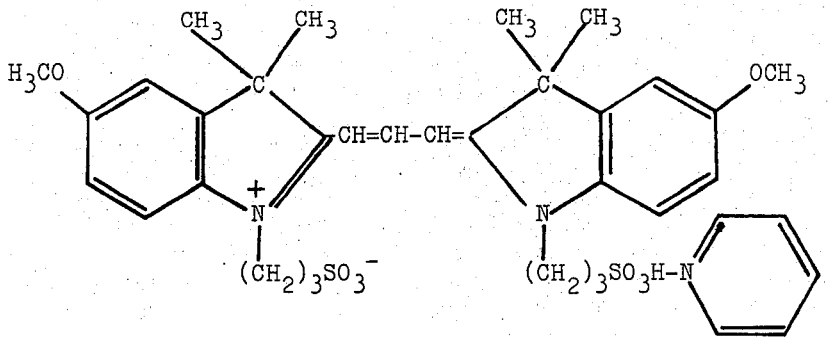

Dye 25

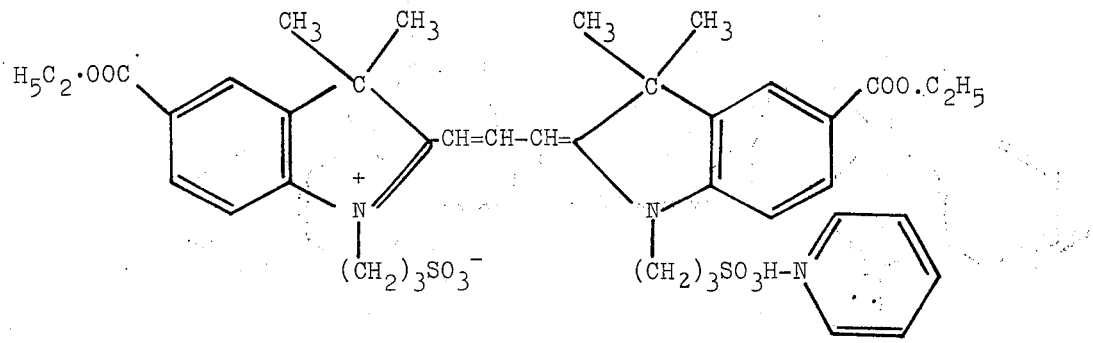

The dye having an indolenine nucleus employed for the present invention has a characteristic feature in that at least one substituent with respect to the N atoms forming the two heterocyclic nuclei is an alkyl containing a carboxyl group or a sulfo radical.

A residual coloring due to a dye differs in accordance with the difference of each dye, and, further, in response to the quantity of the dye added.

The dye of the present invention has the excellent characteristic feature that even when both of the substituents with respect to each N atom forming the two heterocyclic nuclei are of a higher additional quantity than that of the alkyl radicals, its residual coloring is slight.

The emulsification and physical ripening of the silver halide emulsion employed for the present invention are carried out in a similar manner as for a common emulsion, but it is also effective in the case where metal salts of Group VIII of the Periodic Table, for example, iridium salts, rhodium salts, and the like, are added at the time of forming a precipitate or in the course of physical ripening.

In general, it is convenient that the dye represented by general formula (I) be added to an emulsion in the form of a solution, and, in this case, methanol, ethanol, water, or the like is employed as a solvent for the dye.

The quantity of the dye represented by the general formula (I) added to a direct positive silver halide emulsion is within a range of from 1 mg to 200 mg per 1 kg of the emulsion, and particularly effective in a quantity ranging from 10 mg to 100 mg.

It is further preferred that an organic desensitizer be included in the direct positive emulsions of the present invention.

The organic desensitizers used in the present invention are substances which have the ability to trap free electrons generated in silver halide particles on exposure to radiant rays, and are substances which are adsorbed by the silver halide particles. Preferably, they are compounds having a minimum occupied electron energy level lower than that of the valence electron bond of the particles. Measurement of the values of the electron energy levels can be made, though complicated operations are necessary. For example, a determination for simple symmetric cyanine dyes is described in "Photographic Science and Engineering" Vol. 11(3), page 129 (1967), Tani and Kikuchi. Another such determination for typical merocyanine dyes is described in Pre-print (No. B-12) of the "International Congress of Photographic Science" 1970 (Moscow), Shiba and Kubodera.

It is known that the electron energy level correspond primarily to an anode polarographic half-wave potential (Eox) and a cathode polarographic half-wave potential (Ered). Many of such organic desensitizers are described in, for example, U.S. Pat. Nos. 3,023,102, 3,314,796, 2,901,351, 2,541,472 and 3,367,779, in British Pat. Nos. 723,019, 698,575, 698,576, 834,839, 667,206, 748,681, 796,873, 875,887, 905,237, 907,367 and 940,152, French Pat. Nos. 1,520,824, 1,518,094, 1,518,095, 1,520,819, 1,520,823, 1,520,821 and 1,523,626, Belgian Pat. Nos. 722,457 and 722,594, and Japanese Pat. Nos. 13167/1968 and 14500/1968.

Any desensitizer described above can be used in the present invention. However desensitizers which give a particularly preferred result are compounds represented by formula (II) in which the cathode polarographic half-wave potential (Ered) is more positive than −1.0 volt.

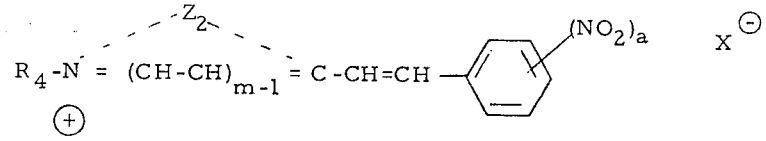

(II)

In formula (II), $R_4$ represents an alkyl group or allyl group, $Z_2$ represents the non-metallic atoms necessary to complete a cyanine heterocyclic nucleus, $X^-$ represents an anion, and *m* and *a* each represents 1 or 2. The above compounds are defined in detail in U.S. Application Ser. No. 318,047 entitled Direct Positive Silver Halide Emulsions, filed Dec. 26, 1972, in the names of Akira Sato et al, which application is hereby incorporated by reference regarding its disclosure on the desensitizers therein.

Specific examples of $R_4$ include a methyl group, ethyl group, butyl group, hydroxyalkyl groups (e.g., an hydroxyethyl group), carboxyalkyl groups (e.g., a carboxymethyl group and a 3-carboxypropyl group) and sulfoalkyl groups (e.g., a 2-sulfoethyl group and a 4-sulfobutyl group).

Other organic desensitizers used in the present invention with success include, for example, phenosafranine, pinakryptol yellow (which is especially effective), 5-m-nitrobenzylidene rhodanine, 3-ethyl-5-m-nitrobenzylidene rhodanine, 3-ethyl-5-(2,4-dinitrobenzylidene)rhodanine, 5-o-nitrobenzylidene-3-phenyl rhodanine, 1',3-diethyl-6-nitrothia-2'-cyanineiodide, 4-nitro-6-chlorobenzotriazole, 3,3'-diethyl-6,6'-dinitro-9-phenyl-thiacarbocyanine iodide, 2-(p-dimethylaminophenyliminomethyl) benzothiazole ethoethyl sulfate, Crystal Violet, 3,3'-diethyl-6,6'-dinitro-thiacabocyanine ethyl sulfate, 1',3-diethyl-6-nitrothia-2'-cyanine iodide, 1,3-diamino-5-methylphenazium chloride, 4-nitro-6-chlorobenzotriazole, 3,3'-di-p-nitrobenzylthiacarbocyanine bromide, 3,3'-di-p-nitrophenylthiacarbocyanine iodide, 3,3'-di-o-nitrophenylthiacabocyanine perchlorate, 3,3'-dimethyl-9-trifluoromethylthiacarbocyanine iodide, 9-(2,4-dinitrophenylmercapto)-3,3'-diethylthiacarbocyanine iodide, bis-(4,6-diphenylpyryl-2-trimethine cyanine perchlorate, anhydrous 2-p-dimethylaminophenyl-iminomethyl-6-nitro-3-(4-sulfobutyl)benzothiazolium hydroxide, 1-(2-benzothiazolyl)-2-(p-dimethylaminostyryl)-4,6-diphenylpyridinium iodide, 1,3-diethyl-5-(1,3-neopentylene-6-(1,3,3-trimethyl-2-indolinylidene)-2,4-hexadienylidene)-2-thiobarbituric acid, 2,3,5-triphenyl-2H-tetrazolium chloride, 2-(4-iodophenyl)-3-(4-nitrophenyl)-5-phenyl-tetrazolium chloride, 1-methyl-8-nitroquinolinium methyl sulfate and 3,6-bis-(4-(3-ethyl-2-benzothiazolinylidene)-2-butenylidene)-1,2,4,5-cyclohexanetetrone.

As examples of the silver halide emulsions used in the present invention, there are silver chloride, silver bromide, silver bromochloride, silver iodochloride and silver iodobromochloride.

Though the silver halide may have a particle size in the range of those as are commonly used in this art, those having an average particle size of 0.05 $\mu$ – 1.0 $\mu$ give a preferred result, the results being particularly effective in the case where the mean particle size of a silver halide is less than 0.6 $\mu$. The silver halide used in the present invention may be composed of either regular particles or irregular particles, but regular particles display a more preferred effect (See U.S. Pat. No. 3,501,306).

While either monodispersed emulsions or non-monodispersed emulsions may be used in the present invention, monodispersed emulsions are preferably used. (See U.S. Pat. No. 3,501,306).

In general, raw emulsions used in direct positive silver halide photosensitive materials are classified into two types.

In one type the emulsion has nuclei for trapping free electrons in the interior of the silver halide crystals, the surface of which has previously been chemically fogged. A characteristic of emulsions of this type is that they directly form positive images themselves, and it is possible not only to increase the spectral sensitization function but also to sensitize the intrinsic absorption region of such emulsions by adding sensitizing dye(s) thereto. In emulsions of this type the compositions of the silver halides present should be adjusted so that chemical sensitizers or metal salts of a Group VIII metal which are used to give free electron trapping nuclei easily enter into the interior of the silver halide.

Further, by addition of the organic desensitizer, it is possible to decrease the minimum density ("clean out") and particularly to prevent "re-reversal". Furthermore, it is possible to increase the maximum density, sensitization and to improve "clean-out" by adding bromine ions in an amount of from 1 to 10 mol% or iodine ions in an amount of from 0.2 to 3 mol% based on the silver halide.

Emulsions of this type are described in U.S. Pat. Nos. 2,401,051, 2,717,833, 2,976,149 and 3,023,102, British Pat. Nos. 707,704, 1,097,999 and 1,520,822, and French Pat. Nos. 1,523,626, 1,520,817 and 1,520,824.

The second type of raw emulsions used in forming direct positives are those which do not have free electron trapping nuclei in the interior of the silver halide but wherein the surface is chemically fogged. These emulsions are silver halide emulsions composed of regular crystals which do not have a twinning plane and which are as free of lattice defects as possible. Such emulsions are preferably pure silver bromide. These emulsions do not form direct positive images themselves. However, if they adsorb organic desensitizer in the silver halide of the emulsions, direct positive images are obtained of high sensitivity.

Emulsions of this type are described in U.S. Pat. Nos. 3,501,306, 3,501,307, 3,501,310 and 3,531,288, British Pat. Nos. 1,186,717, 1,186,714 and 1,186,716 and French Pat. Nos. 1,520,821, 1,520,817, 1,522,354 and 1,520,824.

In the present invention, either of the above raw emulsions can be used, i.e., both raw emulsions can be effectively sensitized by adding the compounds in accordance with the present invention, preferably those represented by formula (I).

The silver halide emulsions used in the present invention can be fogged by light or chemically. The silver halide employed in this invention is fogged to its maximum. The chemical fogging agent must have a characteristic feature such that the silver halide is made to fog without any harmful action with respect to the emulsion. Chemical fog nuclei can be formed by adding, for example, hydrazine derivatives, formalin, thiourea dioxide, polyamine compound, amine borane, methyldichlorosilane stannous chloride and other known agents as disclosed in Belgian Pat. Nos. 721,564 and 708,563, U.S. Pat. No. 2,588,982, British Pat. No. 821,251, French Pat. No. 739,755 and Japanese Pat. No. 14388/1968.

Further, fog nuclei can be formed by using a reducer together with metal ions nobler than silver (for example, gold ions, platinum ions and iridium ions) or further with halogen ions, and disclosed in U.S. Pat. Nos. 2,717,833 and 3,023,102, Belgian Pat. Nos. 713,272 and 721,567 and British Pat. No. 707,704.

After a fogging operation, the pH and pAg of the emulsion are adjusted as necessary, a solution of a dye is added to the emulsion, the resulting mixture is sufficiently agitated, and then the mixture is coated onto a support. With respect to the time of adding the dye to the emulsion, it is convenient to add it to the emulsion immediately before applying, but the dye may be added to the emulsion in the course of ripening after washing with water, or at the time of forming the precipitate prior to the ripening. Ordinary additives such as coating additives and hardening agents may also be added to the emulsion.

In the emulsions used in the present invention, gelatin is usually used as the protective colloid, and inactive gelatin (inert gelatin) is preferably used. Instead of gelatin, however, photographically inactive gelatin derivatives and water soluble synthetic polymers (for example, polyvinyl acrylate, polyvinyl alcohol, polyvinyl pyrrolidone, polyvinyl alginate, carboxymethyl cellulose and hydroxymethyl cellulose) can be used, alone or as mixtures.

The direct positive silver halide emulsions used in the present invention may contain additives such as a fog nuclei stabilizers (e.g., mercapto compounds, thione compounds and tetrazaindene compounds), an agent to decrease minimum density (e.g., stilbene compounds and triazine compounds), a whitening agent, an ultraviolet ray absorbing agent, a harderner (e.g., chromium alum, 2,4-dichloro-s-triazine compounds, aziridine compounds, epoxy compounds, mucohalogen acids and halogenoformyl-maleic acid derivatives), a coating assistant (e.g., sodium polyalkylene sulfonate, saponin and anionic surface active agents having a betaine structure), an antiseptic, a plasticizer (e.g., polyalkylacrylate, alkylacrylate-acrylic acid copolymers and polyalkylene oxide) and a color coupler, (as earlier indicated).

The amount of the organic desensitizer used in the present invention varies depending upon the kind thereof, but $2 \times 10^{-7} - 10^{-1}$ mols per mol of the silver halide(s) is preferably used.

The emulsions according to the present invention can be applied to many kinds of supports to produce photographic elements. The emulsions may be applied to one surface of both surfaces of the support. The support may be transparent or opaque. As typical supports there are cellulose nitrate films, cellulose acetate films, polyvinyl acetal films, polystyrene films, polyethylene terephthalate films and other polyester films, glass, paper, metal, wood, etc. Plastic coated paper can also be used.

After exposure to light, the emulsions according to this invention are preferably treated in a development bath, a fixing bath and a stabilizing bath or in a bath which combines all of these treatments.

The direct positive silver halide emulsions according to the present invention can be used not only for hard direct positive silver halide photosensitive materials such as photosensitive materials for the reproduction of lithotype films and photo-sensitive materials for copying originals, but also for comparatively soft direct positive silver halide sensitive materials such as photosensitive materials for the reproduction of microfilm and photosensitive materials, for the reproduction of X-ray films, etc. Further, they can be used for color photosensitive materials.

The direct positive silver halide emulsions according to the present invention are useful not only in the case of the application of light but also in the case of application of electrons, X-rays and $\gamma$-rays, etc.

EXAMPLE 1

The pH of an AgClBrI (comprising 94 mol % of Br, 40 mol % of Cl, and 20 mol % of I) emulsion was adjusted to a value of 9.0. Fog was imparted thereto by jointly employing hydrazine hydrochloride with a gold salt, and then, the pH of the emulsion was adjusted to substantially 6.0. Pinakryptol yellow was added to the adjusted emulsion, a sensitizing dye was added thereto, a hardening agent and coating additive were added thereto, and the resulting emulsion was applied on a T.A.C. (triacetyl cellulose) base.

After drying the thus coated film, it was subjected to exposure under a light from a light source having a color temperature of 2,666°K through a Fuji Filter-SC-50 (being a yellow filter through which light of a wavelength longer than that of about 510 m$\mu$ is transmitted, the exposed film was developed with a developer having the following formula at a temperature of 20°C for 3 minutes, and was subjected to an ordinary fixation and washed with water.

| Formula of Developer | |
|---|---|
| Metol | 3.1 g |
| Anhydrous Sodium Sulfite | 45 g |
| Hydroquinone | 12 g |
| Anhydrous Sodium Carbonate | 67.5 g |
| Potassium Bromide | 1.9 g. |
| Adding water to the resulting mixture to prepare a total of 1 liter of the mixture in solution. | |

TABLE 1

| Test No. | Ex. No. | Dye No. (C.M.) & Amount Added (mg/Kg Emulsion) | Reversal *4 Sensitivity | Minimum Concentration | Residual Color Concentration*5 |
|---|---|---|---|---|---|
| 1 | 1 | C.M. 14 (90) | 126 | 0.05 | 0.002 |
| 2 | 2 | C.M. 15 (90) | 132 | 0.06 | 0.003 |
| 3 | | *1 C.M. a (90) | 100 | 0.08 | 0.010 |
| 4 | 3 | C.M. 9 (70) | 105 | 0.04 | 0.002 |
| 5 | | *2 C.M. b (70) | 100 | 0.09 | 0.015 |
| 6 | 4 | C.M. 3 (45) | 110 | 0.06 | 0.004 |
| 7 | | *3 C.M. c (45) | 100 | 0.12 | 0.016 |

*1)Dye a

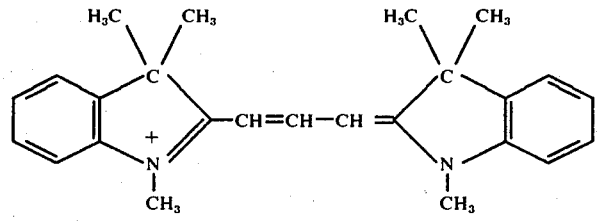

*2)Dye b

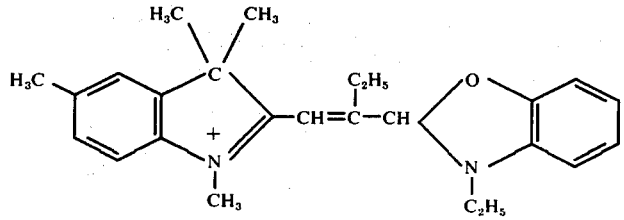

*3)Dye c

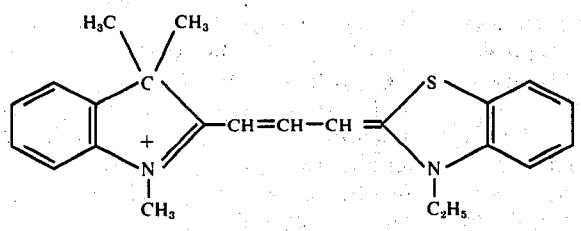

4)Sensitivity is shown by the reciprocal number of the quantity of exposure E required for obtaining a concentration of $D_{max}/2$ and in this case, the sensitivity of a dye for comparison is 100.

5) Residual color concentration is shown by the concentration at the position of absorption maximum of each dye and the concentration is obtained by measuring a test piece, which is prepared by fixing and rinsing a film of an emulsion containing each dye without developing the film, by a spectrophotometer.

Substantially the same spectral absorption curves were obtained from the test pieces of Test Numbers 1–3, 4–5, and 6–7, inclusive, and their absorption maxima were also substantially the same.

EXAMPLE 2

The procedure of Example 1 was duplicated except for employing the following dyes. The residual color densities of thus obtained images are shown in the Table 2 below (determined as in Example 1).

TABLE 2

| Test No. | Dye No. & Amount Added (mg/kg. Emulsion) | Residual Color Density |
|---|---|---|
| 8 | Dye 9 | 0.002 |
| 9 | Dye 10 | 0.004 |
| 10 | Dye D | 0.009 |
| 11 | Dye E | 0.009 |

Dye D

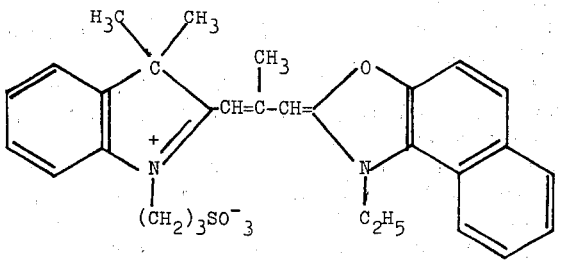

Dye E

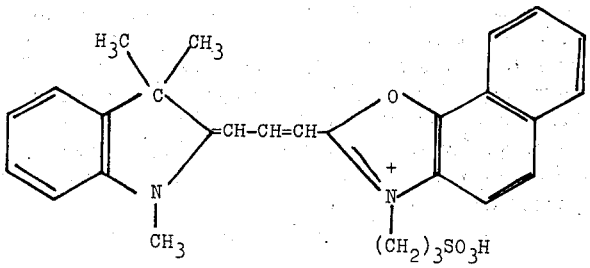

As can be understood from this Table, when Dyes D and E were used, the residual color density was high and, therefore, Dyes D and E are not suitable. That is, dyes where $Z_1$ of general formula is a naphthoxazole ring are not desirable.

From the results shown in the Example 2 of the present invention, it will be seen that the naphthoxazoles are not desirable in the present invention and are excluded therefrom. Further, in the present invention while Z and $Z_1$ can be relatively freely substituted, inferior results are obtained where Z or $Z_1$ is nitro substituted. Accordingly, such embodiments are not desirable in the present invention and are excluded therefrom.

What is claimed is:

1. A direct positive silver halide photographic emulsion, in which the silver halide grains thereof have been fogged to maximum density, containing from one mg to 200 mg per Kg of said emulsion, of a dye represented by the following formula:

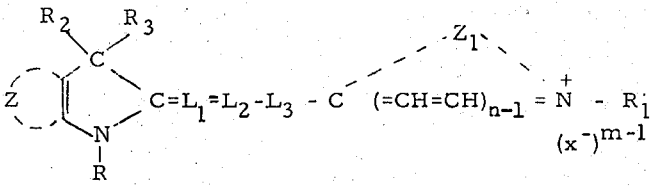

wherein R and $R_1$ are selected from the group consisting of an alkyl group, an allyl group, a substituted alkyl group selected from the group consisting of a 2-hydroxyethyl group, a 3-hydroxypropyl group, a 2-methoxyethyl group, a ketaacetoxyethyl group, a gamma- acetoxypropyl group, a carboxylalkyl group, a sulfoalkyl group, and a phenylethyl group, an aryl group, and a substituted aryl group selected from the group consisting of a methoxyphenyl group and a chlorophenyl group, at least one of said R and $R_1$ being a carboxylalkyl group or a sulfoalkyl group; $R_2$ and $R_3$ are selected from the group consisting of an alkyl group, an aralkyl group, and an allyl group; $L_1$ is selected from the group consisting of a methine group and an atomic group capable of combining with R, $R_2$ or $R_3$ to form a 5- or 6-membered ring; $R_2$ represents a methine group; $L_3$ represents a member selected from the group consisting of a methine group and an atomic group capable of forming a 5- or 6 -membered ring with $R_1$, or with a 3,3-substituent of an indolenine ring, such that a ring may be formed by $L_1$ and $L_3$; X represents an anion; *n* and *m* each represents an integer of 1 and 2, respectively, such that when said dye forms an intramolecular salt, *m* is 1; Z represents an atomic group capable of completing an unsubstituted benzene ring, an unsubstituted naphthalene ring, or a lower alkyl-, lower alkoxy-, chloro-lower alkoxy- carbonyl- substituted benzene ring; and $Z_1$ represents a non-metallic atomic group capable of completing a 5- or 6-membered heterocyclic ring, said ring being a member selected from the group consisting of a 4-methylthiazole ring, a 4-phenylthiazole ring, a 5-methylthiazole ring, a 5-phenylthiazole ring, a 4,5-dimethylthiazole ring, a 4,5-diphenylthiazole ring, a 4-(2-thienyl)-thiazole ring, an unsubstituted thiazole ring, an unsubstituted benzothiazole ring, a 4-chlorobenzothiazole ring, a 5-chlorobenzothiazole ring, a 6-chlorobenzothiazole ring, a 7-chlorobenzothiazole ring, a 4 -methylbenzothiazole ring, a 5-methylbenzothiazole ring, a 6-methylbenzothiazole ring, a 5-bromobenzothiazole ring, a 6-bromobenzothiazole ring, a 5-phenylbenzothiazole ring, a 6-phenylbenzothiazole ring, a 4-methoxybenzothiazole ring, a 5-methoxybenzothiazole ring, a 6-methoxybenzothiazole ring, a 5-iodobenzothiazole ring, a 6-iodobenzothiazole ring, a 4-ethoxybenzothiazole ring, a 5-ethoxybenzothiazole ring, a tetrahydrobenzothiazole ring, a 5,6-dimethoxybenzothiazole ring, a 5,6-dimethylbenzothiazole ring, a 5-hydroxybenzothiazole ring, a 6-hydroxybenzothiazole ring, an unsubstituted alpha-naphthothiazole ring, an unsubstituted beta-naphthothiazole ring, an unsubstuttuted beta, beta-naphthothiazole ring, a 5-methoxy-beta, beta-naphthothiazole ring, a 5-ethoxy-beta-naphthothiazole ring, an 8-methoxy-alpha-naphthothiazole ring, a 7-methoxy-alpha-naphthothiazole ring, a 4'-methoxythionaphthene-7', 6', 4', 5-thiazole ring, an unsubstituted oxazole ring, a 4-methyloxazole ring, a 5-methyloxazole ring, a 4-phenyl-oxazole ring, a 4,5-diphenyloxazole ring, 4,5-dimethyloxazole ring, 4-ethyloxazole ring, a 5-phenyloxazole ring, an unsubstituted benzoxazole ring, a 5-chlorobenzoxazole ring, a 5-methylbenzoxazole ring, a 5-phenylbenzoxazole ring, a 6-methylbenzoxazole ring, a 4,6-dimethylbenzoxazole ring, a 5-methoxybenzoxazole ring, a 5-ethoxybenzoxazole ring, a 5-bromobenzoxazole ring, a 5-iodobenzoxazole ring, a 6-methoxybenzoxazole ring, a 5-hydroxybenzoxazole ring, a 6-hydroxybenzoxazole ring, an unsubstituted selenazole ring, a 4-methylselenazole ring, a 4-phenylselenazole ring, a benzoselenazole ring, a 5-chlorobenzoselenazole ring, a 5-methoxybenzoselenazole ring, a 5-hydroxybenzoselenazole ring, a tetrahydrobenzoselenazole ring, an alpha-naphthoselenazole ring, a beta-naphthoselenazole ring, unsubstituted thiazoline ring, a 4-methylthiazoline ring, an unsubstituted oxazoline ring, an unsubstituted pyridine ring, an unsubstituted 2-pyridine ring, a 5-methyl-2-pyridine ring, an unsubstituted 4-pyridine ring, a 3-methyl-4-pyridine ring, an unsubstituted quinoline ring, an unsubstituted 2-quinoline ring, a 3-methyl-2-quinoline ring, a 5-ethyl-2-quinoline ring, a 6-chloro-2-quinoline ring, an 8-chloro-2-quinoline ring, a 6-methoxy-2-quinoline ring, an 8-hydroxy-2-quinoline ring, an 8-methyl-2-quinoline ring, an unsubstituted 4-quinoline ring, a 6-methoxy-4-quinoline ring, a 7-methyl-4-quinoline ring, an 8-chloro-4-quinoline ring, an unsubstituted 1-isoquinoline ring, a 3,4-dihydro-1isoquinoline ring, an unsubstituted 3-isoquinoline ring, a 3,3-dimethyl-idolenine ring, a 3,3,5-trimethylindolenine ring, a 3,3-dimethyl-5-methoxy-indoleneine ring, a 3,3-dimethyl-5-ethoxycarbonyl-indolenine ring, a 3,3,5,6-tetramethylindoleneine ring, a 3,3-diethyl-indolenine ring, a 3,3-dibenzylindolenine ring, a 3,3-diallylindolenine ring, a 3,3-dimethyl-5-cyanoindolenine ring, a 3,3-dimethyl-6-cyanoindolenine ring, a 3,3-dimethyl-5-chloroindolenine ring, a 3,3-dimethylbenzoindolenine ring, a 3,3-dimethylbenzoindolenine ring, an unsubstituted imidazole ring, a 1-alkyl-imidazole ring, a 1-alkyl-4-phenylimidazole, a 1-alkyl-4,5-dimethylimidazole ring, an unsubstituted benzimidazole ring, a 1-alkylbenzimidazole ring, a 1-aryl-5,6-dichlorobenzimidazole ring, a 1-alkyl-alpha-naphthoimidazole ring, a 1-aryl-beta-naphthiomidazole ring and a 1-alkyl-5-methoxy-alpha-naphthoimidazole ring wherein for $Z_1$ of oxazole or benzoxazole any benzoxazole moiety contains a greater number of aromatic rings than an oxazole moiety.

2. The emulsion as claimed in claim 1 wherein from 10 mg to 100 mg of said dye is present per one Kg of said emulsion.

3. The emulsion of claim 1 where the fogging is chemical fogging.

4. The emulsion of claim 1 where the fogging is with light.

5. The emulsion of claim 1 wherein the mean particle size of the silver halide in said emulsion is less than 0.6 $\mu$.

6. The emulsion of claim 1 which further comprises an organic desensitizer which as the ability to trap free electrons generated in the silver halide particles upon exposure to radiant energy, which organic desensitizer is absorbed by the silver halide particles.

7. The emulsion of claim 6 wherein from $2 \times 10^{-7}$ to $10^{-1}$ mols of said organic desensitizer per mol of silver halide present in the emulsion is used.

8. The emulsion of claim 1 which comprises nuclei for trapping free electrons in the interior of the silver halide of said emulsion, the surface of which silver halide has been chemically fogged.

9. The emulsion of claim 1 wherein said emulsion does not have free electrons trapping nuclei in the interior of the silver halide but wherein the surface of the silver halide of said emulsion is chemically fogged.

10. The emulsion of claim 9 having an organic desensitizer adsorbed on the surface thereof.

11. The emulsion of claim 10 containing from $2 \times 10^{-7}$ to $10^{-1}$ mols of said organic desensitizer per mol of silver halide.

12. The emulsion of claim 1, wherein $L_1$ and $L_3$ are methine groups.

13. The emulsion of claim 1, wherein if R combines with $L_1$ to form said ring it is a five-membered nitrogen containing heterocylic ring;

if $R_1$ combines with $L_3$ to form said ring, it is a five-membered nitrogen contained heterocylic ring; and if $L_1$ combines with $R_2$ and $R_3$ to form said ring, it is a six-membered non-heterocylic ring.

14. The emulsion of claim 1, wherein said oxazole ring is selected from the group consisting of alkyl, dialkyl, phenyl or diphenyl oxazole substituted rings, and said benzoxazole rings are selected from the group consisting of benzoxazole, 5-chlorobenzoxoazole, 5-methylbenzoxazole, 5-phenylbenzoxazole, 6-methylbenzoxazole, 4,6-dimethylbenzoxazole, 5-methoxybenzoxazole, 5-ethoxybenzoxazole, 5-bromobenzoxazole, 5-iodobenzoxazole, 6-methoxybenzoxazole, 5-hydroxybenzoxazole, and 6-hydroxybenzoxazole.

* * * * *